United States Patent [19]

Akkerman

[11] Patent Number: 4,745,971

[45] Date of Patent: May 24, 1988

[54] MULTIPLE STRING WELL PACKER

[75] Inventor: Neil H. Akkerman, Houston, Tex.

[73] Assignee: AVA International Corporation, Houston, Tex.

[21] Appl. No.: 740,827

[22] Filed: Jun. 3, 1985

Related U.S. Application Data

[63] Continuation of Ser. No. 489,737, Apr. 29, 1983, abandoned, which is a continuation-in-part of Ser. No. 435,675, Oct. 21, 1982, Pat. No. 4,505,332.

[51] Int. Cl.[4] ..... F21B 23/00

[52] U.S. Cl. ..... 166/120; 166/134; 166/387

[58] Field of Search ..... 166/57, 120, 121, 122, 166/134, 212, 217, 237, 382, 387

[56] References Cited

U.S. PATENT DOCUMENTS

| | | | |
|---|---|---|---|
| 3,098,524 | 7/1963 | Brown | 166/120 |
| 3,106,961 | 10/1963 | Bigelow | 166/313 X |
| 3,198,254 | 8/1965 | Wise et al. | 166/313 |
| 3,211,226 | 10/1965 | Myers et al. | 166/120 |
| 3,299,959 | 1/1967 | Brown | 166/120 |
| 3,414,058 | 12/1968 | De Rochemont | 166/120 |
| 3,658,127 | 4/1972 | Cochran et al. | 166/120 |
| 4,311,195 | 1/1982 | Mullins, II | 166/120 |

*Primary Examiner*—Stephen J. Novosad
*Assistant Examiner*—Thuy M. Bui
*Attorney, Agent, or Firm*—Vaden, Eickenroht, Thompson & Boulware

[57] ABSTRACT

A multiple well string packer of the type wherein the packer is lowered into a well bore on one of the well strings, and the one string hung off from the wellhead so that the packer may be set at a desired level therein, and wherein the packer, when unset, is retrieved from the well bore on the same string, the other string or strings being lowered into and raised from connection with the packer, when disposed at such level, separately of the one string.

22 Claims, 6 Drawing Sheets

MS
ML
34
24
22
22A
41
60
25 U
42
22 B
WC
25 L
43
44
22C
36
35
35
63A
68
37
70
21
64
20
63
59
65
23
26
40
4
38
61
55
35 A
46
52
51
27
45
39
53
23
46
50
54
32
30
35 B
28
33
31
SP

TL
TS
73
2C
2C
82
78
77
76
78a
MS
ML 81
73
75
3C
3C
82
80
79
74
76
MS
ML

34
MS
ML
24
22A
22
41
42
25 U
WC
22 B
43
44
25 L
22C
70
35
36
21
20
37
65
63A
26
68
63
23
38
61
53
55
46
51
27
33
35 A
45
54
39
91
32
30
92
35 B
SP

MULTIPLE STRING WELL PACKER

This application is a continuation of my copending application, Ser. No. 489,737, filed Apr. 29, 1983, and entitled "MULTIPLE STRING WELL PACKER", now abandoned, which is a continuation-in-part of my patent application, Ser. No. 435,675, filed Oct. 21, 1982, and entitled "WELL PACKERS", now U.S. Pat. No. 4,505,332.

This invention relates in general to dual or other multiple well string packers of the type wherein the packer is lowered into a well bore on one of the well strings, and the one string hung off from the wellhead so that the packer may be set at a desired level therein, and wherein the packer, when unset, is retrieved from the well bore on the same string, the other string or strings being lowered into and raised from connection with the packer, when disposed at such level, separately of the one string. More particularly, it relates to improvements in packers of this type which are unset in response to application of an upward strain to the one string.

In a typical dual well string installation, the dual string packer seals about both strings to close off the space about both strings above an upper production zone, and another packer beneath the dual packer and the lower end of one of the strings (known as the "short string") seals about the other string (known as the "long string") to close off the space below the upper zone but above the lower zone. Thus, oil or gas from the upper zone is produced through the short string, and oil or gas from the lower zone is produced through the long string.

Dual string packers of this general type normally comprise body means on which a packing and slip assembly is carried for expansion and contraction into and out of engagement with the well bore, together with a pair of mandrels extending vertically through side-by-side holes in the body means so that each may be connected as a part of one of the well strings which extend upwardly to the wellhead. When the packer is of the type which is set hydraulically, one of the mandrels is customarily adapted to be temporarily closed so that, with the packer lowered to the desired position, hydraulic fluid may be supplied through one of the strings and the mandrel to which it is connected to means on the body which is operable, in response to such fluid, to expand the normally retracted assembly and thus set the packer. Generally, the expanding means includes sections of the body means above and below the packing and slip assembly which are caused to move toward one another to expand the assembly and away from one another to permit the assembly to retract.

As the packer is lowered into the well bore, the expanding means are held apart by latch means connecting one of the mandrels to the body sections, which latch means is released therefrom in order to permit the expanding means to move to expanding position. In order to unset the packer, the pipe string connected to the one mandrel is raised, upon release of the connection of the one mandrel to the other body section, in order to return the expanding means to a position for causing the packing and slip assembly to contract, whereby the packer may be received from the well bore.

The retrievable type multiple string well packer of my aforementioned prior patent is especially well suited for well installations in which the packer is to be set high in the well bore, and thus in which long sections of well pipe are to be suspended from it. The packer is lowered into and retrieved from the well bore on both well strings, so that each string carries its own weight, and this requires the separate but simultaneous manipulation of elevators for each such string.

However, as compared with the retrievable multiple well string packer of my prior patent, the packer of my present invention is adapted to be set at a considerable depth within the well bore. Hence, the weight of the packer itself and well pipe sections which are suspended therefrom may be supported from one pipe string which is connected to one of the mandrels during lowering and raising of the packer, thus permitting the elevators to be manipulated one at a time. Conventionally, the body means of a packer of this latter type includes a head at the upper end of the other mandrel to which the lower end of the other string may be connected following lowering of the packer to the desired depth on the one string. Ordinarily, hydraulic fluid for setting the packer is supplied to the pressure responsive means thereof through the other string and the mandrel to which it is connected, following lowering of the packer on the one string, so that the packer can be run in on the one string without risk of prematurely setting.

As shown in the packer of my prior patent, the one mandrel is connected to the other body section by means which is shearable in response to an upward strain on the pipe string connected to the one mandrel. Ideally, the shearable means is strong enough to resist an upward strain due to thermal contraction of the one string, and thereby prevent premature release of the packer, but weak enough to permit the packer to be unset when desired by an intentional strain on the one string. When the packer is set high in the well, this ordinarily does not present a serious problem. However, when the packer is set deep in the well, as in the case of the packer of my present invention, the operator is faced with a real dilemma, which may cause him to use an expansion joint in the one well pipe string above the packer. This, however, complicates manipulation of the string at the well head in both running and retrieving the packer.

An object of this invention is to provide a packer of this latter type in which neither a shearable means nor an expansion joint is required to prevent the packer from being prematurely unset by thermal contraction of the one well string on which it is run.

Another object is to provide a packer of the type above described which, in its preferred form, embodies many of the novel and advantageous structural features of the packer of my prior application.

These and outer objects are accomplished, in accordance with the illustrated embodiment of the present invention, by a packer of the type described wherein the other mandrel is connected to the section of the body means to which the one mandrel is shearably connected, and means are provided for connecting the one mandrel to the other mandrel, and thereby preventing the one mandrel from being raised by contraction of the one string, automatically in response to lowering of the other well pipe string into connection with the other mandrel. More particularly, the means for so connecting the one mandrel to the other mandrel is releasable upon raising of the second well pipe string, so that an upward strain may then be taken on the one string to cause the packer and slip assembly to be unset.

As will be described more fully hereinafter, in the preferred and illustrated embodiment of the invention, the one mandrel is connected to expanding means of one section of the body means by latch means which prevents relative vertical movement between that expanding means and the expanding means of another body section which is held apart from the first mentioned expanding means by a releasable connection to the one mandrel during lowering of the packer. More particularly, the other mandrel is shearably connected to the other body section, and the latch means is released in response to hydraulic pressure supplied to pressure responsive means of the body sections, whereby the expanding means of the body sections may be moved toward one another.

As shown, a head on the other mandrel for receiving the other pipe string and the one mandrel are adapted to be connected to one another by means which includes a groove in the one mandrel and a latch carried by the head for shifting into and out of the groove. Thus, the latch is engaged by the other pipe string as it is lowered into connection with the head to shift the latch into the groove, and is engaged by the one mandrel upon raising of the one mandrel to shift the latch out of the groove. More particularly, the groove surrounds the one mandrel, and the latch is a ring whose inner diameter is at least as large as the outer diameter of the one mandrel, so that, when the ring is shifted out of the groove, the one mandrel is free to be raised there through in the process of retrieving the packer.

In the drawings, wherein like reference characters are used throughout to designate like parts:

Figure 1A:
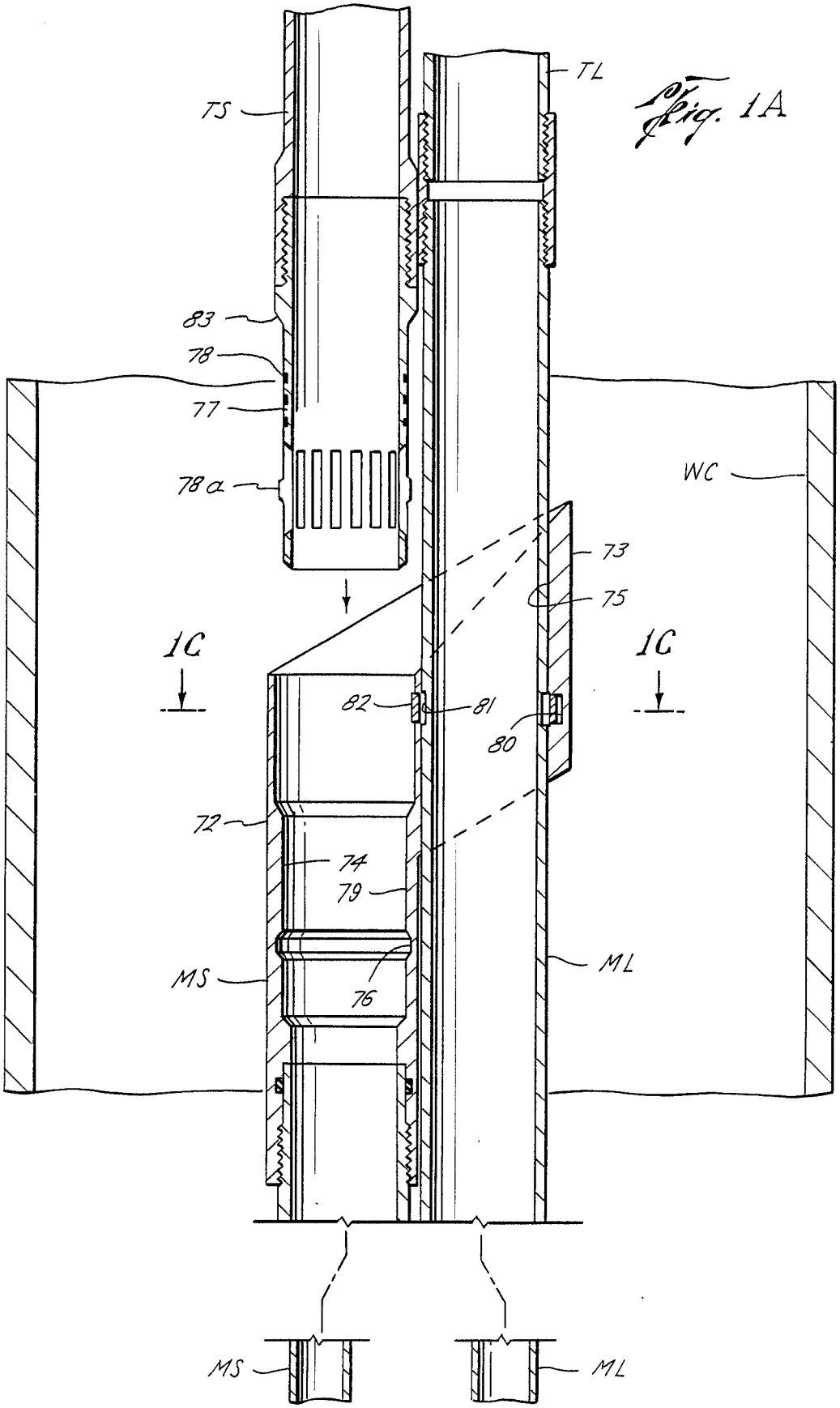
FIG. 1A is an enlarged vertical sectional view of the upper end of the packer as the lower end of the other pipe string is being lowered into releasable connection with the head on the other mandrel.
Figure 1B:
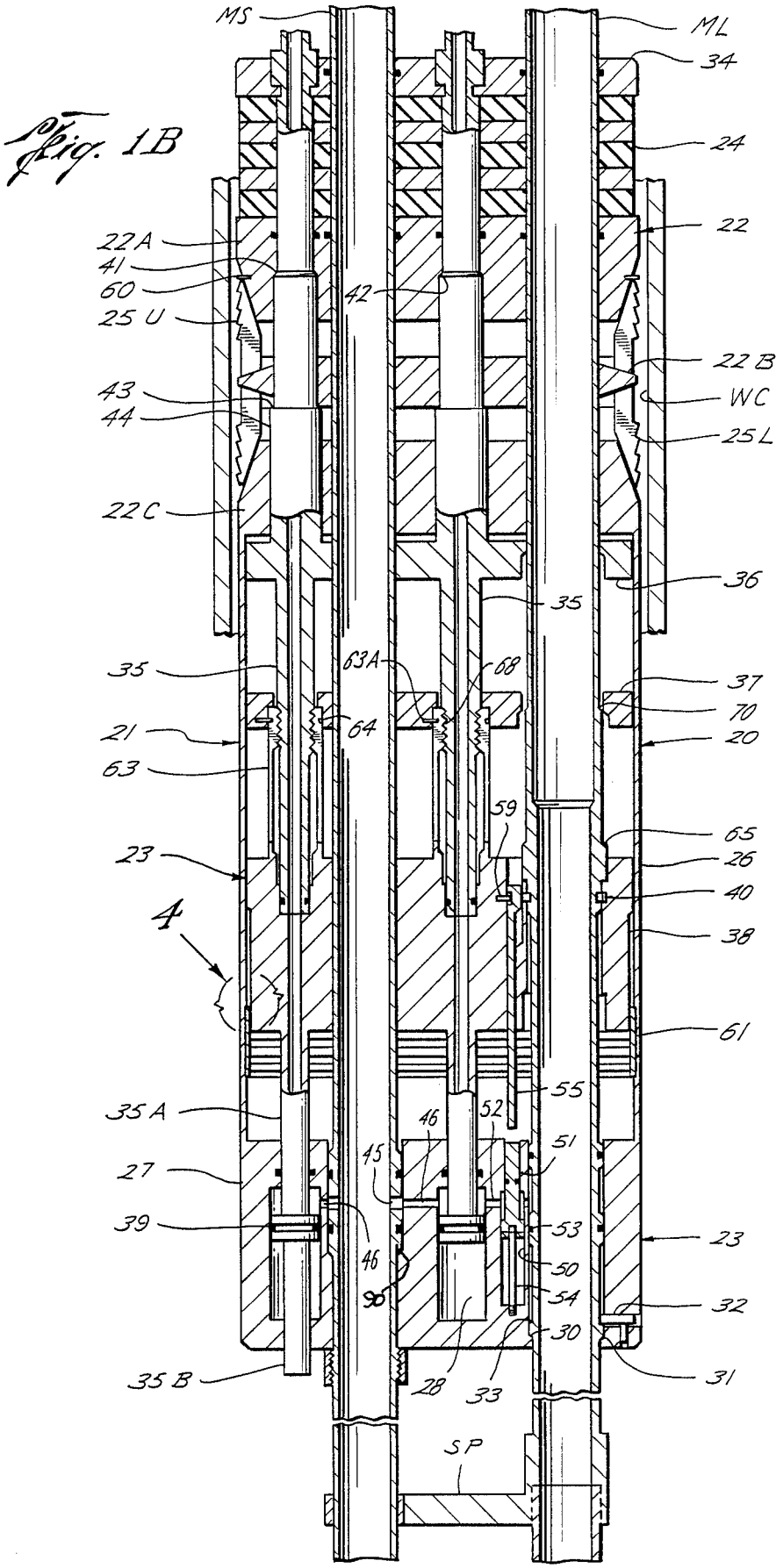
FIG. 1B is a reduced vertical sectional view of the portion of the packer beneath the upper end thereof shown in FIG. 1A opened upon its center line and with the packer and slip assembly thereof shown in its contracted position.
Figure 2C:
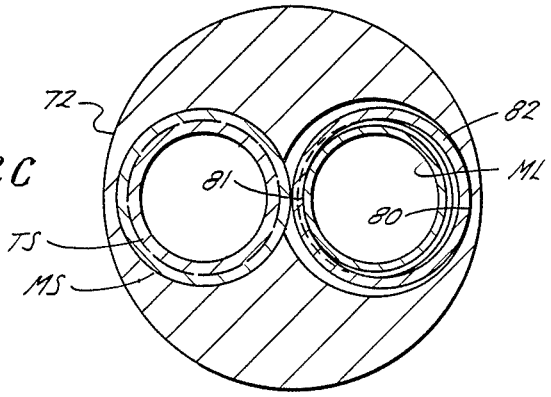
FIG. 2C is a cross-sectional view of the apparatus, as seen along broken lines 2C—2C of FIG. 2A.
Figure 3C:
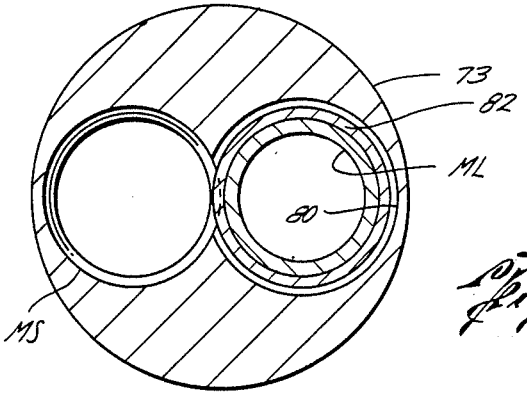
Figure 4:
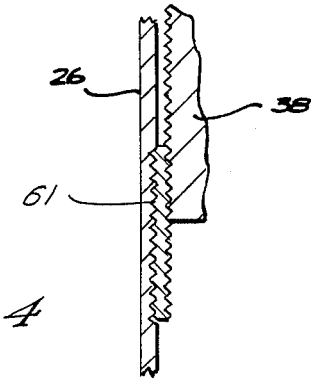
Figure 2A:
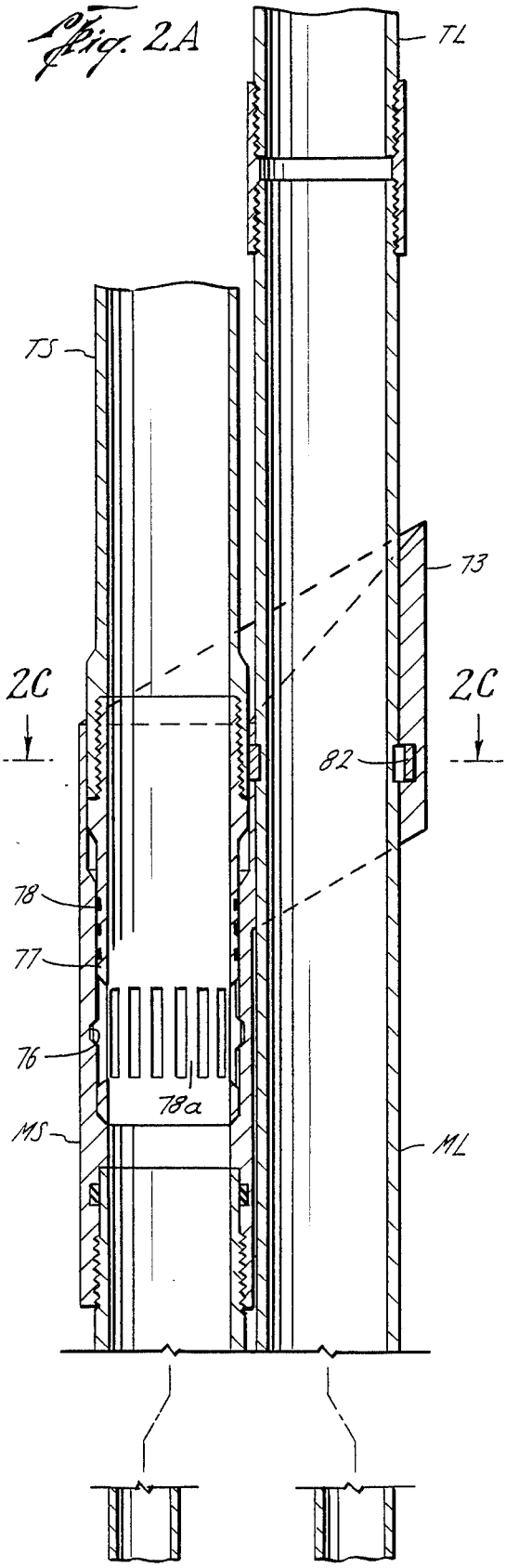
FIG. 2A is a view similar to FIG. 1A, but with the lower end of the pipe string lowered into releasable connection with the head, and the lock ring thereof shifted into a groove about the one mandrel connected to the one pipe string so as to connect them against relative vertical movement.
Figure 3A:
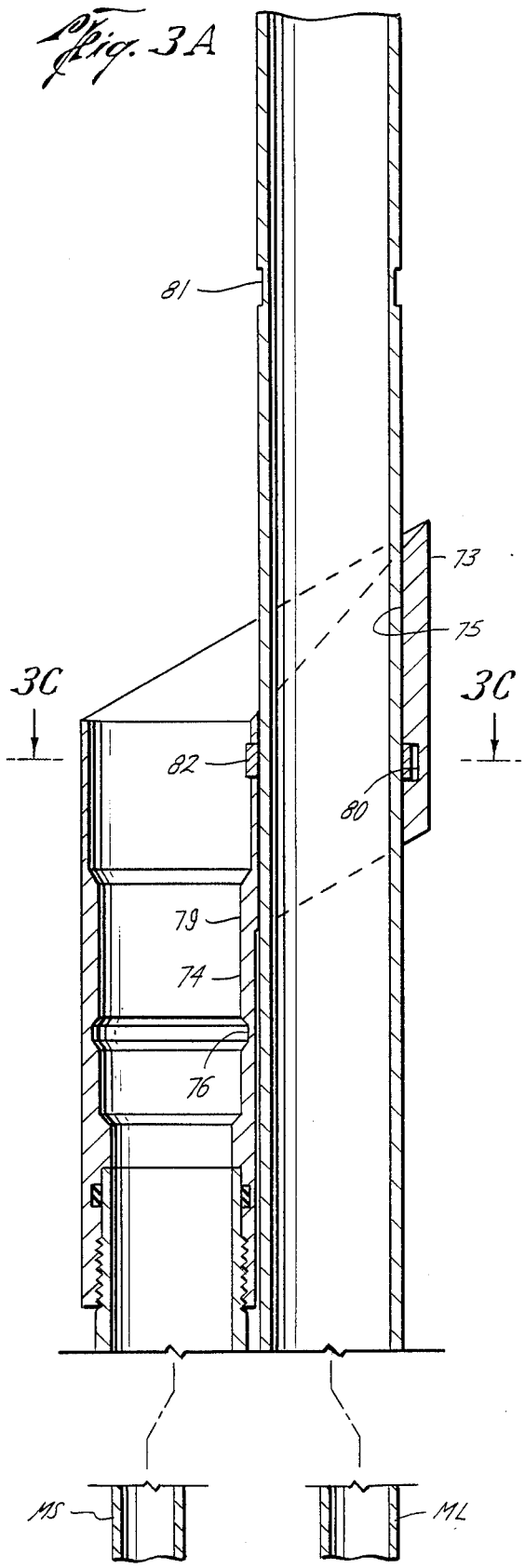
Figure 2B:
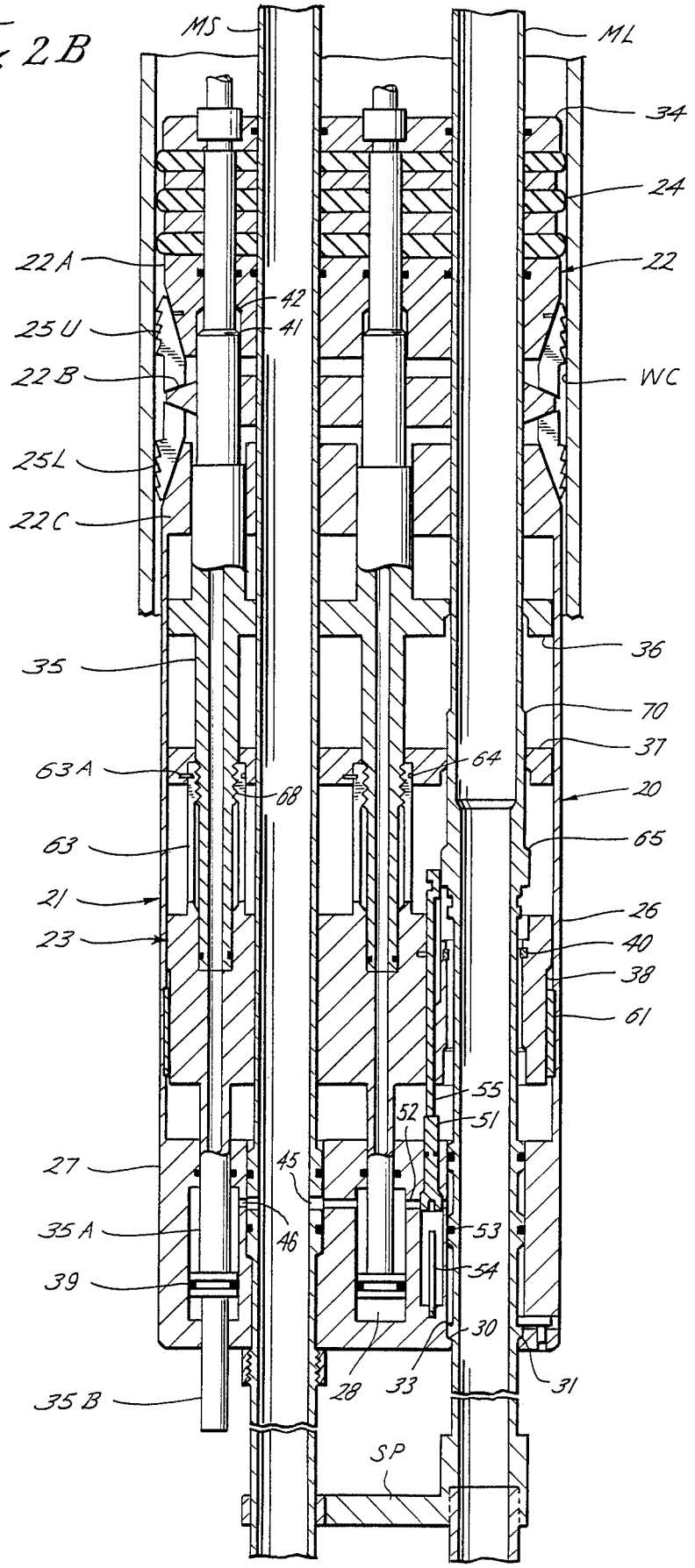
FIG. 2B is another view similar to FIG. 1B, but with the slip and packer assembly expanded into set position upon the supply of hydraulic fluid through the other string and mandrel to a pressure responsive mechanism within the body means of the packer.
Figure 3B:
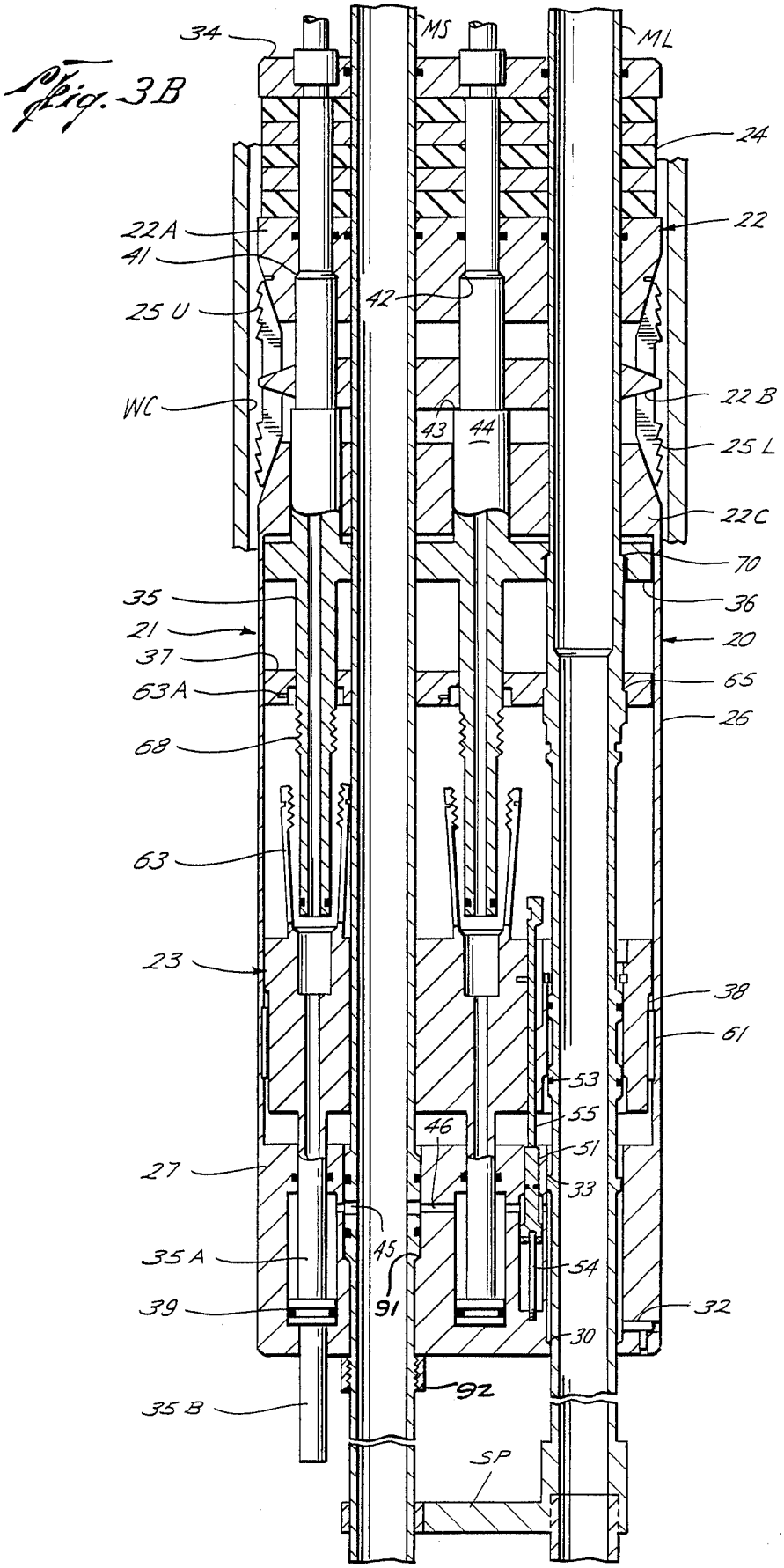

FIGS. 3A and 3B, are views similar to FIGS. 1A and 2A, and FIGS. 1B and 2B, respectively, but upon lifting of the one well pipe string from connection with the head so as to release the one mandrel from connection to the head, and subsequent lifting of the one mandrel to cause the packer and slip assembly to be returned to retracted position preparatory to retrieving the packer from the well casing;

FIG. 3C is a cross-sectional view of the apparatus as seen along broken lines 3C—3C of FIG. 3A; and FIG. 4 is an enlarged detail sectional view of the portion of the apparatus indicated at "4" in FIG. 1B by which the assembly is held in the expanded position of FIG. 2B.

With reference now to the details of the above-described drawings, the overall packer, which is indicated in its entirety by reference character 20, comprises body means 21 made up of coaxially arranged first and second body sections 22 and 23, respectively, and a pair of mandrels ML and MS which extend in side-by-side relation within the body means. Mandrel ML is adapted to be connected as a part of tubing string TL (which may be the "long" string) and mandrel MS is adapted to be connected as a part of tubing string TS (which may be the "short" string), so that, upon installation and setting of the packer, production fluid may be produced through each string.

The body means 21 is connected to the mandrel ML to permit the packer to be lowered with the string TL to a desired level within a well casing WC , following which the string TL is hung off at the wellhead, the other string TS is lowered into connection with the other mandrel MS, and the packer set, as will be described to follow. Thus, as previously described, since the packer is ordinarily installed at a deep elevation within the well bore, the one string is capable of suspending the packer as well as the relatively short tail pipes suspended from it. As will also be described, in order to unset the packer, string TS is raised from connection with mandrel MS, and a strain is taken on string TL to release mandrel ML from the body means and permit the packer to be unset by raising of the string TL.

As shown and described in more detail in my patent, the first body section 22 includes an upper slip expander part or head 22A, an intermediate slip expander part or retainer ring 22B, and a lower slip expander part or head 22C. Upper and lower sets of slips 25U and 25L are carried about the upper and lower expander heads and the intermediate retainer ring, and a packing element 24 is supported by the expander head 22A to form an assembly adapted to be expanded and contracted into and out of gripping engagement with the well bore.

As shown, the mandrels ML and MS extend through side-by-side holes in the assembly which are large enough to permit free vertical movement between the assembly and the mandrels, but which nevertheless permit the packing element to seal about the mandrels when expanded in order to close off the well bore. As shown in my prior patent, there may be four equally spaced-apart groups of slips arranged in pairs on opposite sides of a centerline of the packer, with each group being received and guided within slots in outer conical surfaces of the expander heads.

A tubular housing 26 is connected to the lower expander head 22C for extension downwardly therefrom to surround the mandrels, and a fitting 27 connected to the lower end of the housing has side-by-side holes through which the lower ends of the mandrels extend. As will be described in detail to follow, cylinders 28 are formed in the fitting 27 intermediate the mandrel holes to provide chambers to which hydraulic fluid may be supplied to expand the packing and slip element assembly in order to set the packer. The lower ends of the mandrels beneath fitting 27 are held in spaced relation by a plate SP having holes which closely receive each and connected to the lower end of mandrel ML.

A shoulder 90 about mandrel MS is landed on a seat 91 in the hole in fitting 27 through which mandrel MS is received, and a ring 92 about the mandrel engages the bottom of fitting 27 to hold the mandrel in seated position. Thus, the mandrel MS is fixed against vertical movement with respect to fitting 27.

An internal seat 30 about one of the holes in fitting 27 is engageable with a shoulder 31 about mandrel ML received through that hole, so that, prior to and during setting of the packer, the fitting including cylinders 28 is held against upward movement with respect to the mandrel. Also, a shearable plate 32 is carried within a slot in the side of the fitting so as to engage a shoulder 33 about the mandrel ML above shoulder 31 and thus prevent its upward movement with respect to the fitting until a sufficiently strong upward pull is applied to the mandrel in order to shear the plate.

The second body section 23 includes an upper expander plate 34 above the packing element, and thus on the side of the packing element opposite expander head 22A on which it is supported, and a pair of tubular rods 35 which are connected at their upper ends to the expander plate and extend downwardly therefrom in side-by-side relation. More particularly, the rods are disposed generally diametrically opposite one another intermediate mandrels ML and MS and extend through side-by-side holes in the packing and slip element assembly and into housing 26 for relative vertical movement with respect thereto.

The second body section also includes a spacer plate 36 which is received closely within housing 26 of the first body section and connected to the rods 35 just beneath the lower expander head 22C of the first body section. Holes in plate 36 receive the mandrels ML and MS while holding them in properly spaced relation. As will be described to follow, plate 36 is adapted to be engaged by mandrel ML, as shown in FIG. 3B, so as to lift the tubular rods and thus the expander plate 34 in order to cause the packing and slip element assembly to be returned to contracted position.

Another plate 37 received closely in the housing beneath the plate 36 has holes which receive the rods as well as the mandrels, and a fitting 38 connected to the lower ends of the rods 35 beneath plate 37 is received closely within housing 26 just above fitting 27. As will be described to follow, plate 37 holds from fitting 38 connected to the rods to one another until the plate is engaged by mandrel ML, as shown in FIG. 3B, to lift it out of holding position, whereby the rods are released from fitting 38 for lifting with plate 36, as above described.

As will also be described to follow, fitting 38 is releasably latched to mandrel ML so as to prevent relative vertical movement between the expander parts as the packer is lowered into the well bore. Rod extensions 35A of the rods at the lower side of fitting 38 extend into the cylinders 28 of the fitting 27, and pistons 39 are carried thereby for sealably sliding within the cylinders during setting of the packer, as will be described. The lower end of the rightmost rod extension is closed, while a further extension 35B of the lower end of the leftmost rod passes downwardly beneath its piston and through the lower end of the leftmost cylinder, for purposes described in my prior application.

Fitting 27, housing 26, and lower expander head 22C of the first body section are prevented from moving upwardly with respect to mandrel ML by engagement of shoulder 30 on the fitting with shoulder 31 about the mandrel. At the same time, these same parts of the first body section are supported against downward movement with respect to the mandrel by the engagement of shear plate 32 with shoulder 33 about the mandrel. In addition, a latching ring 40 is releasably disposed in oppositely facing grooves in the hole in fitting 38 through which mandrel ML is received and the outer diameter of the mandrel ML, respectively. Consequently, fitting 38, and thus the tubular rods 35 as well as the upper expander plate 34 of the second body section are prevented from moving vertically with respect to the mandrel ML, whereby the upper expander plate is held in its uppermost position with respect to upper expander head 22A, and the pistons 39 are held in their uppermost positions with respect to the cylinders 28 of the first body section fitting 27.

At the same time, shoulders 41 about the tubular rods are engageable with shoulders 42 about the holes in upper expander head 22A through which the rod extends so as to hold the upper expander head in its upper position with respect to the lower expander head 22C of the first body section. Additionally, shoulders 43 about the rods are engageable with shoulders 44 about the intermediate retainer ring 22B of the first body section so as to hold it in an elevated position with respect to the lower expander head 22C. Thus, with the inner surfaces of the slips of both sets of slips slidably connected by means of dovetail slots to the expander surfaces on the outer sides of the expander heads, and the adjacent ends of the slips of both sets slidably connected by T-heads and slots to the retainer ring 22B, as shown in my prior application, both sets of slips will be held by the expander heads and expander ring in the retracted position shown in FIG. 1B. Also, expander plate 34 of the second body section is so spaced above the expander head 22A as to permit the packing to assume its normally retracted position. Thus, the outer circumferences of the packing element and slips are generally vertically aligned with the outer walls of the various parts of the packer body so as to move freely within the well bore.

With the various parts of the packer held in these positions with respect to one another as well as with respect to mandrel ML, the packer is prevented from accidental setting until it reaches the desired level in the well bore. When the packer is so disposed, well string TS is lowered into connection with the upper end of mandrel MS, as shown in FIG. 2A, and hydraulic fluid is supplied through the string and mandrel to the cylinders 28 above the pistons 39 in order to lower the tubular rods and thus the expander plate 34, whereby the expander parts of the body sections are caused to move relatively toward one another in order to expand both the packing element and the upper and lower set of slips into engagement with the well bore WB, as shown in FIG. 2B.

For this purpose, mandrel MS is adapted to be blocked by suitable means (not shown) beneath ports 45 therein connecting with ports 46 in fitting 27 leading to cylinders 28 above the pistons 39. The latching ring 40 is adapted to be moved to a position to release the connection of mandrel ML to fitting 38, and thus permit the rods 35 and expander plate 34 to move downwardly to expand the packing and slip assembly and thus set the packer automatically in response to the supply of hydraulic fluid to the cylinders 28 above the pistons 39 carried by the rods. Although as described in my prior patent, this hydraulic fluid may be supplied to the cylinders in any one of several ways, as, for example, through a port (not shown) in the right-hand tubular rod 35, it is preferred, in accordance with the present invention, to supply such fluid only through mandrel MS, so that, as previously mentioned, the packer cannot be set until well string TS is connected to mandrel MS.

Another cylinder 50 is formed in the fitting 27 generally intermediate one of the cylinders 28 and the hole through which mandrel ML extends. A piston 51 is sealably slidable in this cylinder 50 and urged in an upward direction by hydraulic fluid which is admitted to the cylinder beneath the piston by means of a port 52 connecting with the right-hand cylinder 28. Initially, the piston 51 is held in the position shown in FIG. 1B by means of a shear pin 53 carried on the upper end of a rod 54 connected at its lower end to the fitting at the lower end of cylinder 50. When hydraulic pressure is supplied to the cylinder, it will provide sufficient force to shear the pin 53, and thus release the piston 51 to move upwardly into engagement with the lower end of a rod 55 vertically slidable within fitting 38 and having means at its upper end which, in the position shown in FIG. 1B, retains latching ring 40 in its latching position.

As shown, the rod 55 is held with its upper retainer head opposite latch ring 40 by means of a shear pin 59 carried by the fitting 38. As shown and described in my prior application, the head of the retainer part has a slot formed therein which receives the free ends of the 40 ring to hold them together and thus hold the ring in its smallest circumferential shape, in which shape the ring bridges the gap between the grooves in the mandrel ML and fitting 38 so as to prevent downward movement of the fitting with respect to the mandrel ML, and thus with respect to the fitting 27. However, when the retainer part and its head are moved upwardly by means of the piston 51, the slot slides above the free ends of the retainer ring so as to permit the ring to expand circumferentially toward its unstressed position, and thus move outwardly into the groove in the fitting and out of the groove about the mandrel ML. As a result, and as shown in FIG. 2B, fitting 38 is free to be moved downwardly by hydraulic fluid within the cylinders 28 above the pistons and thus lower the tubular rods 35 and expander plate 34. To facilitate this downward movement with a minimum of force, the cylinders beneath the pistons are charged with gas at atmospheric pressure or at least some pressure considerably below that of the well bore.

As noted in my prior patent, the latching 40 ring is moved to releasing position with a minimum force, and thus in response to relatively low hydraulic pressure, due to the fact that the force required to shear the pin 53 and thus release the piston 51 is independent of the force required to engage and lift the rod 55. In addition, the spacing of the upper end of piston 51 below the lower end of rod 55 permits the piston to be accelerated upwardly and thus apply an upward jar to the rod, which is helpful in shearing the pin 59 and continuing to move the rod upwardly to a position in which it releases the latching ring 40.

As the rods 35 pull the retainer plate 34 downwardly so as to compress the packing element 24 to some extent, the packing element transmits a downward force to the upper expander head 22A to cause it to begin to move downwardly. This in turn, lowers the upper set of slips 25U to cause the retainer ring 22B to move downwardly, which will in turn exert a downward force on the lower set of slips 25L to cause them to move downwardly with respect to lower expander head 22C. As shown, shear pins 60 are mounted on the upper retainer head 22A adjacent the upper ends of the slips of the upper set 25U, so that this movement of the upper expander head downwardly with respect to the lower expander ring 21C will cause the slips of the lower set to slide downwardly over the lower expander head 22C and into engagement with the well bore prior to the expansion of the slips of the upper set. However, when the lower set of slips have moved outwardly into engagement with the well bore, continued downward movement of the upper expander plate 34 will cause the pins 60 to shear, and thus move the upper set of slips outwardly into gripping engagement with the pipe. With both sets of slips engaging the pipe, continued downward movement of the expander plate 34 will further expand the packing element into sealing engagement with the well bore, as shown in FIG. 2B, thereby setting the packer.

The packer is locked in its set position by means of a body lock ring 61 which is disposed in an annular space between the outer diameter of fitting 38 and the inner diameter of housing 26. Thus, as well known in the art, and as shown in FIG. 4, the body lock ring comprises a split ring having ratchet teeth on its inner diameter engageable with ratchet teeth about the outer diameter of the fitting 38, and cam teeth on its outer diameter engageable with cam teeth on the inner diameter of the housing. The ratchet teeth are so arranged as to permit the fitting to be moved downwardly over the ratchet teeth of the lock ring, as the lock ring moves radially inwardly and outwardly with respect to the cam teeth on the housing 26. However, when the fitting has been so lowered, it is held against return upward movement by the ratchet teeth, and thus locked in its lower, setting position. As will be seen from FIG. 2B, during setting of the packer, shoulders 41 about the tubular rods are lowered beneath the shoulders 42 within the holes of the upper expander head 22A in which it is received. On the other hand, shoulders 43 have moved into the enlarged holes in the lower expander head 22C in which the rods are received.

The ends of the tubular rods are connected to fitting 38 prior to and during setting of the packer by collet fingers 63 which extend upwardly about the rods within the space between the fitting and plate 37. The upper ends of the collet fingers fit within counterbores 64 in the plate 37 to releasably connect teeth thereabout to teeth 68 about the outer diameters of the rods which extend through holes in the plate. A shear pin 63A releasably connects plate 37 to the upper ends of the collet fingers.

As previously mentioned, in order to unset the packer, well string TS is disconnected and raised from mandrel MS, which, as will be described to follow, automatically disconnects mandrel ML from mandrel MS. An upward pull is then applied to mandrel ML to shear plate 32, and thus permit the mandrel to be raised for the purpose of causing the packing and slip assembly to be contracted, and the packer than unset. As mandrel ML is raised, a shoulder 65 thereabout will then move upwardly to engage the lower side of plate 37 (see FIG. 2C), and, upon continued upward movement, shear pin 63A in order to lift the plate 37 and thus raise counterbore 64 above the upper ends of collet fingers 63. The collet fingers are then free to move outwardly to their unstressed positions, as shown in FIG. 3B, and disconnect the lower ends of the tubular rods from fitting 38, thereby permitting the fitting 27 and housing to move downwardly. Since the fitting 38 remains locked to the fitting 27, and seal rings about the lower ends of the upper ends of the rods move out of seal bores within the upper ends of the fitting 38.

Release of the lower ends of the rods from the fitting 38 will permit the fitting to be urged downwardly by the force of hydrostatic pressure which is resisted only by atmospheric pressure in the cylinders 28 beneath the pistons 39. This not only holds the lower ends of the rods down, but also forces the fitting 38 downwardly with sufficient force to jar against the upper end of the fitting 27 so as to assist it in moving downwardly in the event it is otherwise stuck. Upon continued upward movement of the mandrels, a shoulder 70 about the mandrel ML will engage the spacer plate 37, and thus lift it and the tubular rods 35, and consequently the expander plate 34, a further upward distance sufficient to permit the packing element to fully retract to the position shown in FIG. 3B.

As shown in each of FIGS. 1A, 2A and 3A, a head 72 at the upper end of the mandrel MS includes a cylindrical body 73 having a recess 74 for receiving the lower end of the tubing string TS for connection to the mandrel MS, and a recess 75 to one side of the bore 74 to receive the upper end of the mandrel ML. The upper end of the head is dish shaped so as to provide a surface which guides the lower end of the tube string TS into the recess 74, and the recess 74 has a groove 76 thereabout for releasable connection with spring fingers 78*a* of a pipe section on the lower end of string TS. When the tubing string and mandrel are so connected, seal rings 78*a* carried about the pipe section 77 sealably engage a reduced bore 79 in the recess 74 so as to provide a sealed connection between them. When it is desired to disconnect the tubing string TS from the mandrel MS and raise it from the well bore, an upward strain is applied to the string TS so as to release the spring finger 78 from the groove 76.

In these respects, the upper end of the mandrel MS is similar to prior mandrels of packers of this type. However, as distinguished from such prior packers, the head 72 of the packer of the present invention also includes a means for releasably connecting it, and thus the mandrel MS to which it is connected, to the other mandrel ML automatically in response to lowering of the well string TS into connection with the mandrel MS, and, upon lifting of the tubing string TS from connection with the mandrel MS, automatically releasing the head and thus the mandrel MS from connection to the mandrel ML. As previously discussed, with the mandrels connected to one another, as shown in FIG. 2A, the mandrel and string TL are prevented from contracting above such connection, and the shear plate 32 is thereby prevented from prematurely shearing. On the other hand, upon retrieval of string TS to release the connection between the mandrels, as shown in FIG. 3A, an upward strain may be applied to the mandrel ML so as to shear the plate 32 and raise the mandrel ML in order to unset the packer and thus retrieve the packer.

Figure 1C:
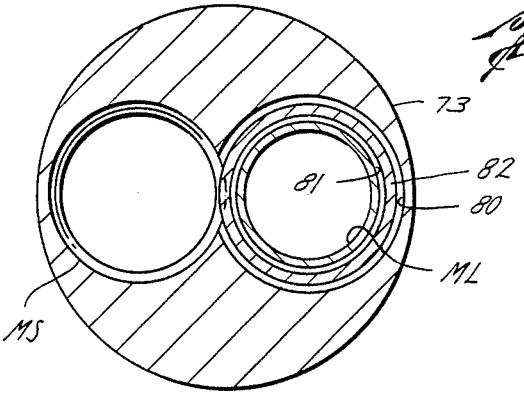
FIG. 1C is a cross-sectional view of the apparatus, as seen along broken lines 1C—1C of FIG. 1A.

This means for so connecting or disconnecting the mandrels with respect to one another comprises an annular groove 80 which is formed in the head concentrically of the bore 75 therein and of a diameter which is sufficiently large that the outer diameter of the groove overlaps the inner diameter of the recess 74. An annular groove 81 is also formed about the mandrel ML opposite the groove 80 when the mandrel ML is connected to the body means of the packer, as shown in FIG. 2C. A ring 82 of a diameter just greater than the outer diameter of the mandrel ML is disposed about the mandrel ML and opposite the grooves 80 and 81 for shifting laterally with respect to them. More particularly, the ring 82 is somewhat thicker than the dividing wall between the upper end of the recess 74 and the bore 75 so that, when the ring is coaxial with bore 75, its left hand side will project inwardly into the upper end of the recess 74, as shown in FIGS. 1A and 1C. Thus, as the pipe section at the lower end of well pipe string TS is lowered into connection with the mandrel MS, a downwardly facing shoulder 83 thereabout will engage the portion of the ring 82 projecting into the upper end of the recess 74 so as to shift the ring to the right and thus into the left hand side of the groove 81 about the mandrel ML, and a cylindrical portion of the string TS above the shoulder moves opposite the ring so as to hold the ring in a position connecting mandrel ML to the head, and thus to the mandrel MS, as shown in FIG. 2A.

When the well string TS is lifted from connection with the mandrel MS, prior to unsetting the packer, upward movement of the shoulder 83 on the pipe section 77 above ring 82 will free the ring for shifting laterally out of the connecting position of FIGS. 2A and 2C. Consequently, upon subsequent lifting of the pipe string TL to shear the shear plate 32, and then raise the pipe string to cause the packer to be unset, the lower edge of the groove 81 about the mandrel ML will force the left hand side of the cam ring upwardly and to the left and thus return the ring 82 upwardly and to the left and thus to a position coaxially of the mandrel ML, as shown in FIGS. 3A and 3C, whereby the mandrel is free to move upwardly with respect to the head 72.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A multiple string well packer, comprising body means disposable within a well bore, a packing and slip assembly carried by the body means for expansion and contraction into and out of engagement with the bore, first and second mandrels having means for connection to first and second well pipe strings, respectively, and extending vertically through the body means, means connecting the first mandrel to the body means, whereby the body means may be lowered with the first well pipe string to a desired level in the bore, said means connecting the first mandrel to the body means including releasable latch means preventing expansion of said assembly as the body means is so lowered, means for releasing said latch means and expanding the assembly in order to set the packer when the body means has been so lowered, means for causing the assembly to contract in order to unset the packer in response to raising of the first well pipe string following disconnection of the first mandrel from the body means, means connecting the second mandrel to the body means, and means on the second mandrel for connecting the second mandrel to the first mandrel, and thereby preventing raising of the first well pipe string when the first mandrel is disconnected from the body means, automatically in response to lowering of the second well pipe string into connection with the second mandrel, said last-mentioned means connecting the second mandrel to the first mandrel being releasable upon raising of the second well pipe string, whereby said first well pipe string may be raised to unset the packer and retrieve it from the well bore.

2. A packer of the character defined in claim 1, wherein the means on the second mandrel for connection to the second well pipe string comprises a head which receives the first mandrel, and the means for connecting the first and second mandrels includes a groove in the first mandrel, and a latch carried by the head for shifting into the groove when engaged by the second well pipe string as it is lowered into connection with the head, and shifting out of the groove, when engaged by the first mandrel upon raising of the first mandrel with the first well pipe string.

3. A packer of the character defined in claim 2, wherein the groove surrounds the first mandrel, and the latch is a ring whose inner diameter is at least as large as the outer diameter of the mandrel received in the head.

4. A packer of the character defined in claim 3, wherein the head has a hole to receive the lower end of the second pipe string.

5. A packer of the character defined in claim 1, wherein the means for expanding the assembly includes pressure responsive means in the body means, and including means for supplying control fluid to the pressure responsive means through said second mandrel when said second well pipe string is connected thereto.

6. A multiple string well packer, comprising body means disposable within a well bore, a packing and slip assembly supported by the body means for expansion and contraction into and out of engagement with the well bore, said body means including first and second body sections having means for expanding the packing element and slip assembly into engagement with the well bore upon movement from one position to another with respect to one another, first and second mandrels having means for connection to first and second well pipe strings, respectively, and extending vertically through the body means, releasable latch means connecting the expanding means of the second body section to the first mandrel, means on the first mandrel releasably connected with the expanding means of the first body section, whereby the body means may be lowered with the first well pipe string to a desired level within the well bore with the packing and slip assembly contracted, means for releasing the latch means and moving the expanding means of the body sections toward said other position to expand said packing and slip assembly into engagement with the well bore, when the body means has been so lowered, means automatically responsive to such movement of the expanding means of said body sections toward said other position for holding the assembly in expanded position, means responsive to raising of the first mandrel, following release of said connection at the first mandrel with the expanding means of the first body section, for causing the packing and slip assembly to return to contracted position, means connecting the second mandrel to the first body section, and means on the second mandrel for connecting the second mandrel to the first mandrel, automatically in response to lowering of the second well pipe section into connection with the second mandrel following lowering of the body means to the desired level, whereby the first mandrel cannot be raised with respect to the first body section upon release of said connection of the first mandrel with the expanding means of the first body section, said last-mentioned connecting means being releasable in response to raising of the second well pipe string from the second mandrel, whereby the first well pipe string may be raised to cause the packing element and slip assembly to be returned to contracted position.

7. A packer of the character defined in claim 6, wherein the means on the second mandrel for connection to the second well pipe string comprises a head which receives the first mandrel, and the means for connecting the first and second mandrels includes a groove in the first mandrel, and a latch carried by the head for shifting into the groove when engaged by the second well pipe string as it is lowered into connection with the head, and shifting out of the groove, when engaged by the first mandrel upon raising of the first mandrel with the first well pipe string.

8. A packer of the character defined in claim 7, wherein the groove surrounds the first mandrel, and the latch is a ring whose inner diameter is a least as large as the outer diameter of the second mandrel received in the head.

9. A packer of the character defined in claim 8, wherein the has a hole to receive the lower end of the second pipe string.

10. A packer of the character defined in claim 5, wherein the means for expanding the assembly includes cylinder means formed in one of said body sections, piston means on the other body section for reciprocation within the piston means, and means including port means connecting the second mandrel to the cylinder means in order that control fluid may be supplied to said cylinder means through the second pipe string connected to the second mandrel in order to move the expanding means of said body sections from said one to said other position.

11. A multiple string well packer, comprising body means disposable within a well casing, a packing and slip assembly supported by the body means for expansion and contraction into and out of engagement with the well bore, said body means including first and second body sections having means for expanding the packing element and slip assembly into engagement with the well bore upon vertical movement from one position to another with respect to one another, first and second mandrels having means for connection to first and second well pipe strings, respectively, and extending vertically through the body means, releasable latch means connecting the expanding means of the second body section to the first mandrel, the first mandrel being releasably connected to the expanding means of the first body section, so as to hold the expanding means in said one relative vertical position, whereby the body means may be lowered with the first well pipe string to a desired level with the well bore with the packing an slip assembly contracted, means for releasing the latch means and moving the expanding means of the body sections toward said other position to expand said packing and slip assembly into engagement with the well casing, when the body means has been so lowered, means automatically responsive to such movement of the expanding means of the body sections toward said other position for locking them against return movement toward said one position, and thereby holding the assembly in expanded position, said second body section including releasably connected parts intermediate the locking means and the expanding means thereof which are released for relative vertical movement in response to raising of said first mandrel, following release of the connection of the first mandrel from the expanding means of the first body section, whereby the expanding means of said second body section may be raised with said first mandrel to cause the packing and slip assembly to return to contracted position, means connecting the second mandrel to the first body section, means on the second mandrel for connecting the second mandrel to the first mandrel automatically in response to lowering of the second well pipe section into connection with the second mandrel following lowering of the body means to the desired level, whereby the first mandrel cannot be raised with respect to the second body section upon release of the means connecting the first mandrel to the expanding means of the first body section, said last-mentioned means connecting the second mandrel to the first mandrel being releasable in response to raising of the second well pipe string from the second mandrel whereby the first well pipe string may be raised to cause the packing element and slip assembly to be returned to contracted position.

12. A packer of the character defined in claim 11, wherein the means on the second mandrel for connection to the second well pipe string comprises a head which receives the first mandrel, and the means for connecting the first and second mandrels includes a groove in the first mandrel, and a latch carried by the head for shifting into the groove when engaged by the second well pipe string as it is lowered into connection with the head, and shifting out of the groove, when engaged by the first mandrel upon raising of the first mandrel with the first well pipe string.

13. A packer of the character defined in claim 12, wherein the groove surrounds the first mandrel, and the latch is a ring whose inner diameter is at least as large as the outer diameter of the mandrel received in the head.

14. A packer of the character defined in claim 13, wherein the head has a hole to receive the lower end of the second pipe string.

15. A packer of the character defined in claim 11, wherein the means for expanding the assembly includes cylinder means formed in one of said body sections, piston means on the other body section for reciprocation within the piston means, and means including port means connecting the second mandrel to the cylinder means in order that control fluid may be supplied to said cylinder means through the second pipe string connected to the second mandrel in order to move the expanding means of said body sections from said one to said other position.

16. A multiple pipe string well packer, comprising body means disposable within a well bore and including first and second body sections which are vertically movable with respect to one another, a packing and slip assembly carried about the body means for expansion and contraction into and out of engagement with the well bore, first and second mandrels having means for connection to first and second pipe strings, respectively, and extending through the body means in side by side relation, means including a shearable connection between one of the body section and first mandrel for supporting the body sections in a first relative vertical position in which the assembly is contracted, means for moving the body sections to and holding them in a second relative vertical position in which the assembly is expanded, means responsive to raising of the first mandrel to shear its releasable correction to the one body section for releasing said body sections from their said second relative vertical position and moving them to their first relative vertical in order to permit the assembly to contact, means supporting the second mandrel from the first body section, and laterally shiftable means for latching the first mandrel with respect to the second mandrel, in response to lowering of the second well pipe string into connection with the second mandrel, and unlatching said first mandrel in response to raising of the second pipe string from connection to the second mandrel.

17. A well packer of the character defined in claim 16, wherein the assembly is carried about the first means with the packing above the slips, and the other body section includes means above the packing which is lowered to expand the assembly and raised with the second mandrel to permit the assembly to contract.

18. A well packer, of the character defined in claims 16 or 17, wherein the second well pipe string is connected to and disconnected from the second mandrel solely in response to vertical movement.

19. A well packer of the character defined in claims 16 or 17, wherein the second mandrel includes a head which receives the first mandrel, there is a groove in the first mandrel, and the latching means includes a latch carried by the head in position to be shifted into the groove by means on the second well pipe string, as the second string is lowered into connection with the head, and shifted out of the groove, when said second string is disconnected from the second mandrel, by means on the first mandrel upon raising of the first mandrel with the first well pipe string.

20. A well packer of the character defined in claim 19, wherein the groove surrounds the first mandrel, and the latch is a ring whose inner diameter is at least as large as the outer diameter of the first mandrel received in the head.

21. A well packer of the character defined in claim 20, wherein the means on the second string comprises a tubular member connectable to the lower end of the second string and having cam means thereon engagable with the latch ring to shift it into the groove in the first mandrel.

22. A well packer of the character defined in claim 21, wherein there is a groove in one and laterally shiftable means on the other of the second mandrel and the tubular member for releasably connecting them to one another upon continued lowering of the member following shifting of the latch ring.

* * * * *